US006446481B1

(12) United States Patent
Ballard et al.

(10) Patent No.: US 6,446,481 B1
(45) Date of Patent: Sep. 10, 2002

(54) VEHICLE INTERCHANGEABLE REPAIR SYSTEM

(75) Inventors: James G. Ballard, Waukesha; Jeffrey Russell, Summit; James C. Graham, Waukesha, all of WI (US)

(73) Assignee: Hein-Werner Corporation, Waukesha, WI (US)

( * ) Notice: Subject to any disclaimer, the term of this patent is extended or adjusted under 35 U.S.C. 154(b) by 0 days.

(21) Appl. No.: 09/726,830

(22) Filed: Nov. 30, 2000

Related U.S. Application Data

(60) Provisional application No. 60/168,521, filed on Dec. 2, 1999.

(51) Int. Cl.[7] ..... B21J 13/00

(52) U.S. Cl. ..... 72/446; 72/447; 72/457; 72/705

(58) Field of Search ..... 72/447, 457, 705, 72/446; 269/9, 58, 59

(56) References Cited

U.S. PATENT DOCUMENTS

| | | | | | |
|---|---|---|---|---|---|
| 4,313,335 | A | | 2/1982 | Eck | 72/457 |
| 4,592,225 | A | | 6/1986 | Eck | 72/457 |
| 4,660,405 | A | * | 4/1987 | Widegren et al. | 72/705 |
| 4,781,045 | A | * | 11/1988 | Celette | 72/705 |
| 4,794,783 | A | | 1/1989 | Eck | 72/447 |
| 4,986,107 | A | * | 1/1991 | Peyret | 72/705 |
| 5,355,711 | A | * | 10/1994 | Chisum | 72/705 |
| 5,596,900 | A | * | 1/1997 | Pietrelli | 72/705 |
| 5,916,322 | A | * | 6/1999 | Venalainen | 72/705 |
| 5,931,043 | A | | 8/1999 | Liegel et al. | 72/457 |

* cited by examiner

*Primary Examiner*—Ed Tolan
(74) *Attorney, Agent, or Firm*—Foley & Lardner

(57) ABSTRACT

The vehicle interchangeable repair system comprises a repair platform having a carriage mounted thereon and structured to move along the periphery of the repair platform. An accessory platform is removably coupled to the carriage and an interchangeable tool is removably mounted on the accessory platform. The vehicle interchangeable repair system allows an operator to modify the vehicle repair system to accommodate the type of vehicle and type of vehicle repair that has to be affected on such vehicle. The vehicle repair system can receive interchangeable tools as selected by an operator of the system. The carriage is structured to move along the periphery of the repair platform a full 360 degrees to a position as selected by the operator. Additional carriages can be mounted on the repair platform and support the same type of interchangeable tool or different interchangeable tools as selected and determined by the operator.

12 Claims, 3 Drawing Sheets

VEHICLE INTERCHANGEABLE REPAIR SYSTEM

RELATED APPLICATIONS

This application claims the benefit of U.S. Provisional Application No. 60/168,521, filed Dec. 2, 1999.

FIELD OF THE INVENTION

The present invention relates to the vehicle repair field and more particularly to a system for moving, positioning and manipulating a vehicle and vehicle parts on an interchangeable repair system utilizing a variety of devices coupled to the repair system.

BACKGROUND OF THE INVENTION

In the vehicle repair business, a damaged or in-need-of-repair vehicle is usually brought to a vehicle body shop or the like for corrective procedures. Vehicle bodies and frames come in different shapes and sizes, from the smallest foreign made vehicles to pick-up trucks. To repair such vehicles, the vehicle repair facility must have available a repair system, usually called a "rack" or a "frame pulling" bench or an "in-floor system." During the repair procedure, there are a variety of tools that are utilized by an operator to effect a proper repair of a vehicle. In addition to the repair system rack or bench having a force applying device mounted thereon, an operator might also require a cutting device, or a welding device or a winch or a measuring system, etc. Each of these individual devices, are typically mounted on its own carriage or set of wheels or some such other manipulating system that must be moved from one side of the vehicle repair system to another side depending on the work required. An operator must maneuver such devices from one position to another position typically over the floor of the vehicle repair facility which requires movement of other tools or apparatus which is inefficient and time consuming.

Thus there is a need for a vehicle repair system that provides for easy maneuvering of various tools and apparatus utilized during a vehicle repair procedure. There is a further need for an interchangeable repair system that allows for the interchangeability of tools and apparatus mountable on a vehicle repair rack or bench that can be moved anywhere around the circumference of the vehicle being repaired, i.e., have a 360 degree maneuver capability.

SUMMARY OF THE INVENTION

The present invention provides a vehicle interchangeable repair system and a method for using the same in a vehicle repair facility. The vehicle interchangeable repair system comprises a repair platform having a carriage mounted thereon and configured to move along the periphery of the repair platform. An accessory platform is removably coupled to the carriage and an interchangeable tool is removably mounted on the accessory platform. The vehicle interchangeable repair system allows an operator to modify the vehicle repair system to accommodate the type of vehicle and type of vehicle repair that has to be affected on such vehicle. The vehicle repair system can receive interchangeable tools as selected by an operator of the system. The carriage is configured to move along the periphery of the repair platform a full 360 degrees to a position as selected by the operator. Additional carriages can be mounted on the repair platform and support the same type of interchangeable tool or different interchangeable tools as selected and determined by the operator.

The present invention also provides the method for repairing a vehicle with a vehicle interchangeable repair system. The method comprises the steps of securing a vehicle-to a repair platform of the vehicle interchangeable repair system and selecting an interchangeable tool to perform a procedure on the vehicle. The method also includes mounting the interchangeable tool on an accessory platform and coupling the accessory platform to a carriage mounted on the repair platform. The operator moves the carriage along the periphery of the repair platform to a selected position, locks the carriage in the selected position and uses the interchangeable tool on the vehicle to affect a repair procedure. A repair procedure can include the moving, positioning, manipulating, removing and measuring the vehicle and vehicle parts. The method can also include the steps of selecting a second interchangeable tool and mounting the second interchangeable tool into a second carriage. The operator can then use the second tool on the vehicle during the repair procedure. A third and additional tool can be mounted on additional carriages or interchanging a third tool for either the first or second tool and using the third tool on the vehicle.

The present invention also provides a vehicle interchangeable repair system comprising a means for supporting and securing the vehicle, a means for carrying mounted on the means for supporting and configured to move along the periphery of the means for supporting, a means for accessorizing, removably coupled to the means for carrying and an interchangeable tool removably mounted on the means for accessorizing. The vehicle interchangeable repair system can also include a means for locking to fix the position of the means for carrying on the means for supporting. The means for carrying can also be provided with a means for positioning to fix the position of the means for accessorizing. The vehicle interchangeable repair system can also include at least one additional means for carrying mounted on the means for supporting with an additional means for accessorizing having another interchangeable tool removably mounted thereon removably coupled to such additional means for carrying.

DETAILED DESCRIPTION OF THE PREFERRED EMBODIMENTS

Figure 1:
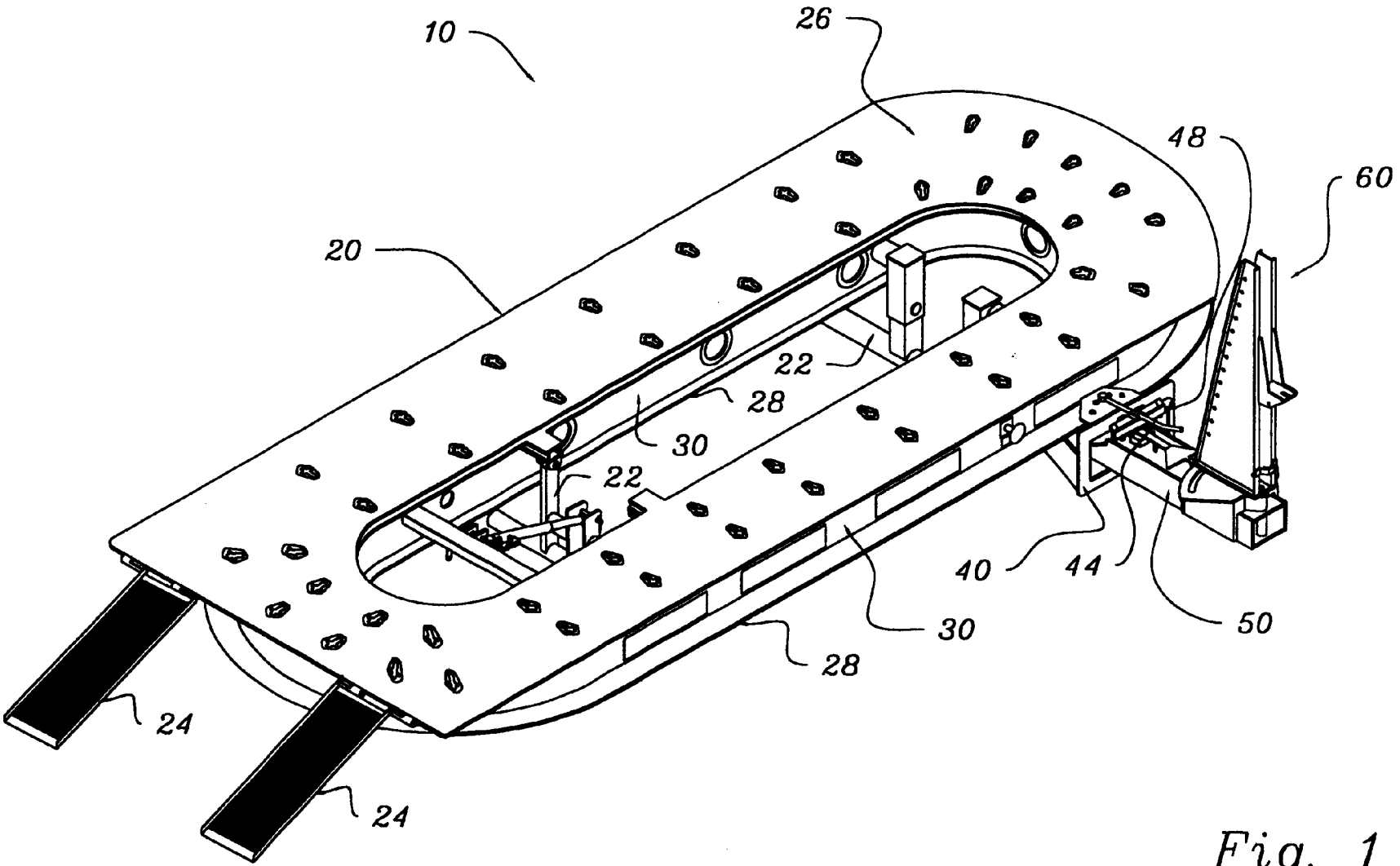
FIG. 1 is a prospective view illustrating a vehicle interchangeable repair system (rack type) having a carriage coupled to the periphery of the repair rack and having an interchangeable tool, of the pull tower type, mounted on an accessory platform coupled to the carriage.

Referring to FIG. 1, there is illustrated a vehicle interchangeable repair system (10). It's principal parts include a repair platform (20), a carriage (40) mounted on the perimeter of the repair platform for maneuvering along said perimeter, an accessory platform (50) removably coupled to the carriage (40) and an interchangeable tool (60) mounted on the accessory platform (50). The present vehicle interchangeable repair system (10) is structured to allow an operator to customize or build a specific vehicle repair system especially for a particular procedure on a specific vehicle. The present vehicle interchangeable repair system (10) receives different devices that can be interchangeably connected into the carriage (40) attached to the work repair platform (20) and structured to maneuver completely around the repair platform (20) circumference. In other words, when a vehicle is secured to the work surface (26) of the repair platform (20) the carriage (40) supporting the accessory platform (50) and an interchangeable tool (60) can be maneuvered entirely around the vehicle and be positioned in the most advantageous and convenient location around the repair platform (20) as determined by the operator.

The repair platform (20) is provided with one or more leg sets (22) for adjusting the height of the repair platform (20) above the floor surface of the vehicle repair facility. The leg set (22) can be a fixed height assembly, or a variable height assembly utilizing hydraulic or pneumatic cylinders to raise or lower the repair platform (20) as determined by the operator. Ramps (24) are removably attached to the repair platform (20) to facilitate the movement of the vehicle on and off the repair platform (20). The ramps (24) can be placed on one end or the other end of the repair platform (20) or they can be placed on both ends of the repair platform (20) to provide a drive-through capability to the vehicle interchangeable repair system (10). The repair platform (20) is also provided with a bottom plate (28) and an intermediate web (30) which provides the structural integrity of the repair platform (20). Typically, the hydraulic or pneumatic plumbing (not shown) is routed in the interior space formed by the work surface (26), the bottom plate (28) and the intermediate web (30) of the repair platform (20). A plurality of openings are provided in the intermediate web (30) to allow access to the plumbing and such other procedures as are deemed necessary by the operator of the system. The work surface (26) of the repair platform (20) can be provided with a plurality of openings to facilitate the procedures utilized to service a vehicle placed on the repair platform (20).

Figure 2:
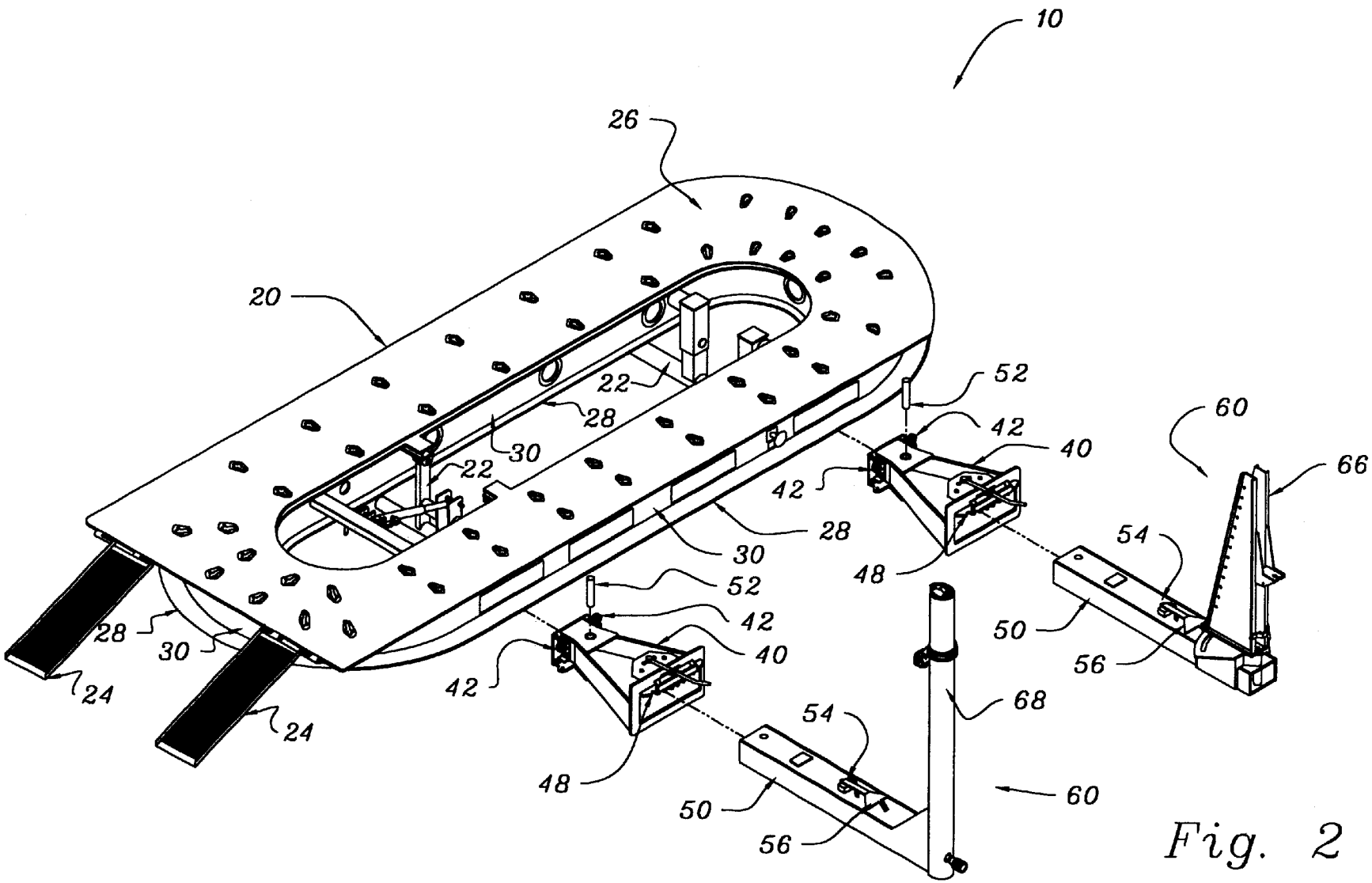
FIG. 2 is a prospective view illustrating the vehicle interchangeable repair system with two embodiments of an interchangeable tool mounted respectively on an accessory platform which are coupled to two carriages mountable to the repair platform.

Referring now to FIGS. 1 and 2, the vehicle interchangeable repair system (10) is provided with at least one carriage (40) which is coupled to the repair platform (20). The carriage (40) is provided with traverse rollers (42) which engage the bottom plate (28) of the repair platform (20) to facilitate the movement of the carriage (40) around the circumference of the repair platform (20) and thereby having a 360 degree maneuverability capability. The carriage (40) is also provided with a carriage lock (44) and a carriage lock pin (46) which is used to set and lock the position of the carriage (40) at a given location around the periphery of the repair platform (20) as determined by an operator. The carriage (40) is also provided with a lateral position assembly (48) which facilitates the side to side positioning of the accessory platform (50) as will be described below. It should be understood that the carriage (40) can be coupled to the repair platform (20) in any convenient and conventional manner such as rails that are attached to the work surface (26) or the bottom plate (28) of the repair platform (20).

The interchangeability feature of the present vehicle interchangeable repair system (10) is the accessory platform (50) which is coupled and locked to the carriage (40). The accessory platform (50) is provided with a hole at one end which receives a pivot pin (52) mountable in the carriage (40). A pivot lock (54) manipulated by a pivot lock handle (56) is provided on the accessory platform (50) with the pivot lock (54) engaging the lateral position assembly (48) of the carriage (40) to position the accessory platform (50) in a side to side orientation within the carriage (40) is determined by the operator. The accessory platform (50) pivots about the pivot pin (52) which allows the positioning of the accessory platform (50) and the interchangeable tool (60) mounted thereon as determined by the operator. The accessory platform (50) can be of any convenient length and cross-section, however the preferred embodiment is a square cross-section hollow tube. The hollow tube facilitates and receives the hydraulic and pneumatic plumbing and electrical wiring to accommodate the interchangeable tools (60) mounted on the platform.

FIG. 2 illustrates two embodiments of the interchangeable tool (60) that is mounted on the accessory platform (50). One embodiment is a pull tower (66) and the other embodiment is a tube type pull tower (68) both of which are force applying devices utilized in a vehicle repair procedure. It should be understood that the interchangeable tool (60) can be of the same type mounted in a separate carriage (40) during the repair procedure or they may be of different types (as illustrated in FIG. 2) during a repair procedure.

Figure 3:
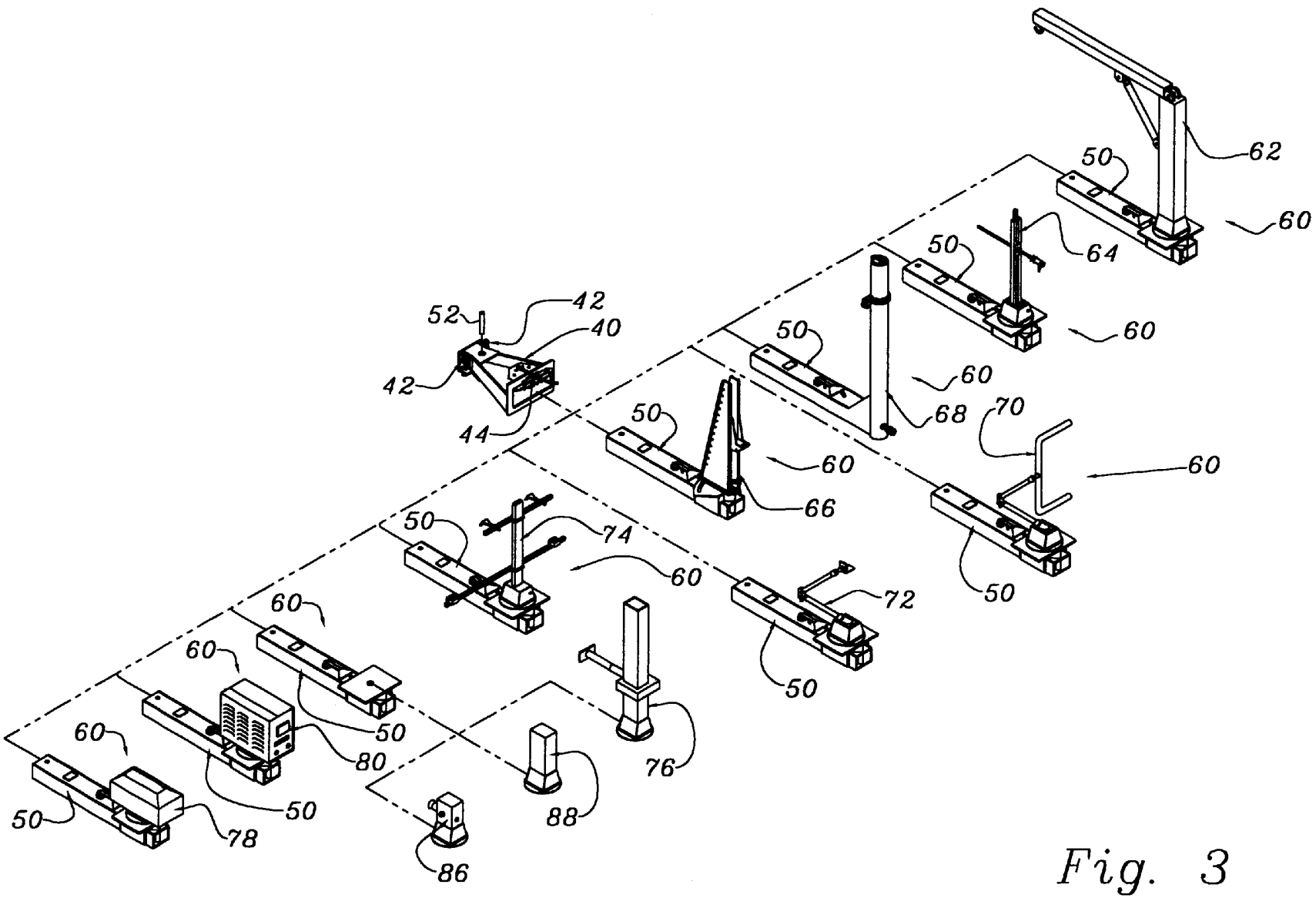
FIG. 3 is a prospective view illustrating a variety of interchangeable tools that are mountable on an accessory platform which engages a carriage of the present vehicle interchangeable repair system.

FIG. 3 illustrates a variety of interchangeable tools (60) that can be mounted on the accessory platform (50) and coupled to the carriage (40) of the present vehicle interchangeable repair system (10). The type of tools illustrated are a crane (62), a dent puller (64), a pull tower (66), a tube type pull tower (68), a measuring system (70), a part holding assembly (72), a door/bumper holding assembly (74), a push/pull assembly (76), a winch (78), a welder (80), a plasma cutter (82), a vacuum recovery system (84), a video system (86), and a tool (88).

The measuring system (70) can be any coordinate determining system. For example, the measuring system (70) can be mechanical, such as a tram gauge, or an electromechanical system. The measuring system (70) can utilize lasers, or audio waves, or use any device that can transmit and/or receive electromagnetic energy. The measuring system can also utilize an optical-camera system, such as a combination of light emitting diodes and charge-coupled devices. The welder (80) can be any suitable welding system, such as a shielded metal-arc, gas metal-arc (MIG), gas tungsten-arc, or oxyacetylene system. It is contemplated by the present vehicle interchangeable repair system (10) that any one of such interchangeable tools (60) can be mounted on an accessory platform (50) and coupled to the carriage (40) mounted on the repair platform (20). It is also contemplated that two or more carriages (40) can be mounted on the repair platform (20) with the same or alternative interchangeable tools (60) mounted in the respective carriages (40) as determined by an operator to perform the given procedure in the most efficient and convenient manner. It is contemplated that any type of tool (88) that can be mounted on the accessory platform (50) can be utilized in the present vehicle interchangeable repair system (10).

Thus, there is provided a vehicle interchangeable repair system for use in a vehicle repair facility. While several embodiments of the present invention have been disclosed in detail herein, various modifications may be made. For example, the carriage may be mounted on a mobile platform that is anchored to a floor of a repair facility utilizing an in-floor track system or anchor pots. By way of further modification, the interchangeable tool may be mounted on the accessory platform such that the interchangeable tool can be pivoted independently of the lateral movement of the accessory platform within the carriage. Such modifications and variations in use are intended to fall within the scope of the appended claims.

What is claimed is:

1. A vehicle interchangeable repair system, comprising:

a repair platform;

a carriage mounted on the repair platform and configured to continuously move along the periphery of the repair platform;

an accessory platform removably coupled to the carriage, the carriage having a lateral position assembly to fix the position of the accessory platform; and, an interchangeable tool removably mounted on the accessory platform.

2. The vehicle interchangeable repair system of claim 1, wherein the carriage is provided with a carriage lock to fix the position of the carriage on the repair platform.

3. The vehicle interchangeable repair system of claim 1 further comprising at least one additional carriage mounted on the repair platform with an additional accessory platform, having another interchangeable tool removably mounted thereon, removably coupled to such additional carriage.

4. The vehicle interchangeable repair system of claim 1, wherein the interchangeable tool is selected from the group consisting of a crane, a dent puller, a pull tower, a tube type pull tower, a measuring system, a part holding assembly, a door/bumper holding assembly, a push/pull assembly, a winch, a welder, a plasma cutter, a vacuum recovery system, a video system and a tool.

5. A method for repairing a vehicle with a vehicle interchangeable repair system, the method comprising the steps of:

securing a vehicle to a repair platform of the vehicle interchangeable repair system;

selecting an interchangeable tool to perform a procedure on the vehicle;

mounting the interchangeable tool on an accessory platform;

coupling the accessory platform to a carriage mounted on the repair platform;

moving the carriage along the periphery of the repair platform to a selected position;

locking the carriage in the selected position; and, using the interchangeable tool on the vehicle to affect a repair procedure.

6. The method of claim 5, wherein the step of selecting an interchangeable tool includes selecting the interchangeable tool from the group consisting of a crane, a dent puller, a pull tower, a tube type pull tower, a measuring system, a parts holding assembly, a door/bumper holding assembly, a push/pull assembly, a winch, a welder, a plasma cutter, a vacuum recovery system, a video system, and a tool.

7. The method of claim 5 including the steps of selecting a second interchangeable tool;

mounting the second interchangeable tool into a second carriage; and, using the second tool on the vehicle.

8. The method of claim 7 including the steps of:

selecting a third interchangeable tool;

exchanging the third tool for either the first or second tool; and, using the third tool on the vehicle.

9. A vehicle interchangeable repair system, comprising:

a means for supporting and securing the vehicle;

a means for carrying mounted on the means for supporting and configured to continuously move along the periphery of the means for supporting;

a means for accessorizing removably coupled to the means for carrying, the means for carrying having a means for positioning to fix the position of the means for accessorizing; and, an interchangeable tool removably mounted on the means for accessorizing.

10. The vehicle interchangeable repair system of claim 9, wherein the means for carrying is provided with a means for locking to fix the position of the means for carrying on the means for supporting.

11. The vehicle interchangeable repair system of claim 9 further comprising at least one additional means for carrying mounted on the means for supporting with an additional means for accessorizing, having another interchangeable tool removably mounted thereon, removably coupled to such additional means for carrying.

12. The vehicle interchangeable repair system of claim 9, wherein the interchangeable tool is selected from the group consisting of a crane, a dent puller, a pull tower, a tube type pull tower, a measuring system, a parts holding assembly, a door/bumper holding assembly, a push/pull assembly, a winch, a welder, a plasma cutter, a vacuum recovery system, a video system, and a tool.

* * * * *